United States Patent [19]

Simon

[11] Patent Number: 4,907,636

[45] Date of Patent: Mar. 13, 1990

[54] DECORATIVE WINDOW SHADE

[75] Inventor: Terry L. Simon, Rockford, Ill.

[73] Assignee: Newell Co., Rockford, Ill.

[21] Appl. No.: 295,098

[22] Filed: Jan. 9, 1989

[51] Int. Cl.[4] ..... A47G 5/02

[52] U.S. Cl. ..... 160/238; 428/40

[58] Field of Search ..... 428/40, 192, 193; 160/238, 236, DIG. 7; 24/DIG. 11; 248/205.3, 467

[56] References Cited

U.S. PATENT DOCUMENTS

| | | | |
|---|---|---|---|
| Re. 10,015 | 1/1882 | Norman | 160/DIG. 7 |
| 276,152 | 4/1883 | Barricklo | 160/DIG. 7 |
| 1,997,484 | 4/1935 | Collins | 160/DIG. 7 |

*Primary Examiner*—Blair M. Johnson
*Attorney, Agent, or Firm*—Baker & McKenzie

[57] ABSTRACT

A device for decorating a window shade includes a flat strip of polyester material having pre-applied adhesive and removable covers on both sides thereof. Printed instructions for decorating the shade are provided on the covers. A decorative wallpaper or fabric is applied to one side of the polyester strip, and the strip is then applied to the lower portion of the window shade. The polyester strip has a thickness which allows it to be cut with a scissors. The adhesive used on the polyester strip is compatible with both the material of the shade and various decorative materials.

9 Claims, 1 Drawing Sheet

DECORATIVE WINDOW SHADE

BACKGROUND AND SUMMARY OF THE INVENTION

This invention relates to means and a method for decorating a window shade. In particular, the invention relates to a device whereby a consumer can easily customize a window shade to match or otherwise blend with the decor of a room.

Window shades have for many years been sold as plain utilitarian products. In recent years, various attempts have been made to stylize window shades by incorporating color and texture into the material (usually fabric or vinyl) comprising the shade, or by applying to the shade, at the point of manufacture, a layer of decorative material.

Pre-applied decoration creates difficulties, however. The pre-application makes large inventories necessary, and since the tastes of consumers vary considerably, there will necessarily be a large unserved market of consumers who will not be satisfied with the decoration provided by the manufacturer, even if manufacturers stock a significant number of decorative styles and configurations.

It is therefore an object of this invention to provide consumers with means by which they can customize decoration of a window shade in coordination with the decor of their choice.

Another object of this invention is to provide mean for decorating a window shade with a strip of wallpaper or fabric.

A further object of this invention is to make the customized decoration of window shades a simple project which can be easily accomplished by an ordinary consumer.

Another object is to provide means for decorating a window shade which will be sufficiently durable to withstand substantial temperature variations.

Yet another object is to provide a window shade package which includes means for decorating the shade with a wallpaper or fabric strip whereby the strip will not wrinkle or curl.

Still another object of the invention is to provide means for decorating a window shade without the need for a separate step of applying adhesive to the shade or to the decorative material being applied.

Still another object of the invention is to provide a window shade and accompanying means for decorating the shade, whereby adhesive, which is compatible with the shade, is pre-applied to a strip to which decorative material may be applied.

These and other objects of the invention are achieved with a window shade package which includes a window shade and a flat polyester strip to which adhesive has been pre-applied to both sides. The strip has removable cover sheets protecting the adhesive, and instructions for use are printed on at least one of the sheets. The instructions explain the steps by which an ordinary consumer can customize the shade with material of his choice, such as wallpaper or fabric which blends with the decor of the room in which the shade is to be installed. The strip is dimensioned to be rigid enough to resist rolling around the shade roller and the make the strip easy to apply to the shade without being too floppy; and yet, flexible enough to be cut with a household scissors. The polyester material of the strip is chosen on the basis of its ability to resist temperature changes without overly expanding or contracting, and its ability to withstand the effects of sunlight.

BRIEF DESCRIPTION OF THE INVENTION

The objects and advantages of the present invention will be better understood upon a reading of the following specifications read in conjunction with the accompanying drawings wherein.

DETAILED DESCRIPTION OF THE INVENTION

Figure 1:
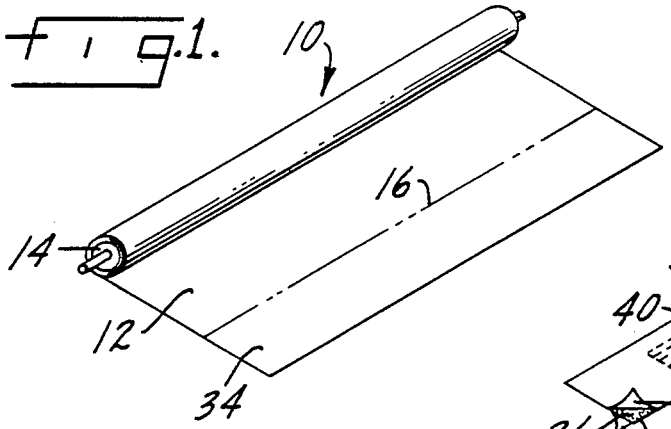
FIG. 1 is a perspective view of a window shade to be decorated in accordance with the present invention.
Figure 2:
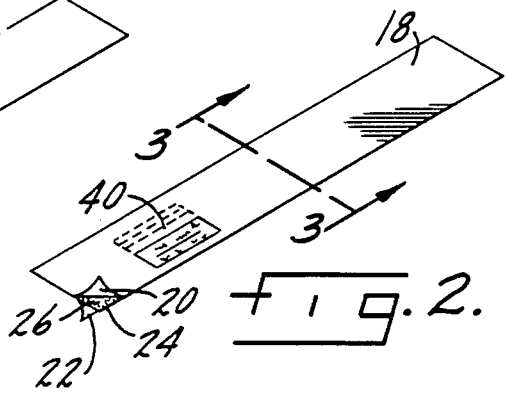
FIG. 2 is a perspective view of the double-sided adhesive strip of the present invention.

FIG. 1 shows a shade 10 having a flexible sheet 12 wound partially around a roller 14. The light line 16 is shown on the shade to mark the position of the double-sided adhesive strip 18, shown in FIG. 2.

Figure 3:
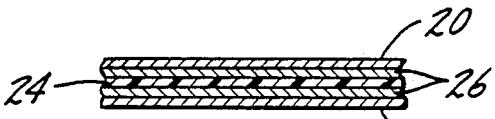
FIG. 3 is a sectional view taken along line 3—3 of FIG. 2.

The covered mounting strip 18, a sectional view of which is shown in FIG. 3, has upper and lower release papers or covers 20 and 22, respectively. The mounting strip 24 is preferably a clear polyester sheet onto both sides of which an adhesive 26 has been applied. The adhesive 26 is formulated to be compatible with the sheet material 12 of the shade 10 to which the mounting strip will be applied. When vinyl shade material is used, an acrylic adhesive is preferred. It has been found that this adhesive material has the characteristics of becoming stronger in its adhesion the longer it remains in contact with the polyester mounting strip 24 and the sheet 12 of the shade. The combination of acrylic adhesive 26 and polyester mounting strip 24 provides a system which can withstand the rigorous temperature extremes to which window shades are subjected. The extremes are rigorous because shades are often exposed to direct sunlight and the cold of winter drafts. The relatively low coefficient of thermal expansion of polyester makes it particularly suitable for use as a mounting strip, since large thermal movement would tend to delaminate the mounting strip from both the shade 12 and the decoration 48.

Figure 4:
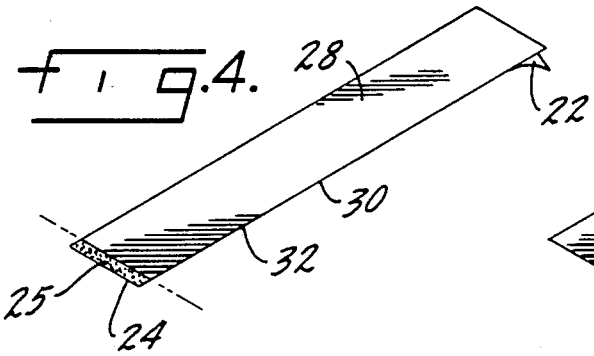
FIG. 4 is a perspective view of the strip of FIG. 2 with a decorative sheet applied thereto.
Figure 5:
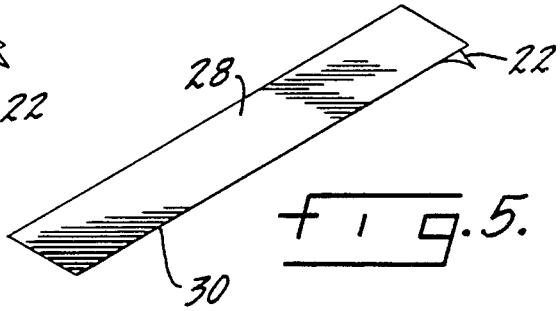
FIG. 5 is a perspective view of a decorative sheet ready to be applied to a shade.

FIGS. 4 and 5 show a decorative strip 28 which may be wallpaper (either wood fiber, vinyl or canvas) or other material, such as fabric, chosen to match the existing decor of a room. In FIG. 5, the decoration 28 is shown as matching the shape of the mounting strip 24, with the expanding piece 25 removed. It is important that the thickness of the mounting strip be thin enough so that the extending piece 25 can be cut by hand with a scissors, and that such cutting not be difficult or require more than ordinary strength. Depending upon the pattern, if any, of the decoration 28, it may be rough cut so that upon trimming the edges thereof, the pattern will be symmetrically disposed on the mounting strip 24. To ensure proper alignment of the decoration 28 on the mounting strip 24, it is recommended that a true or machine cut edge 30 of the material comprising the decoration 28 be aligned with a machine cut edge 32 of the mounting strip 24.

Figure 6:
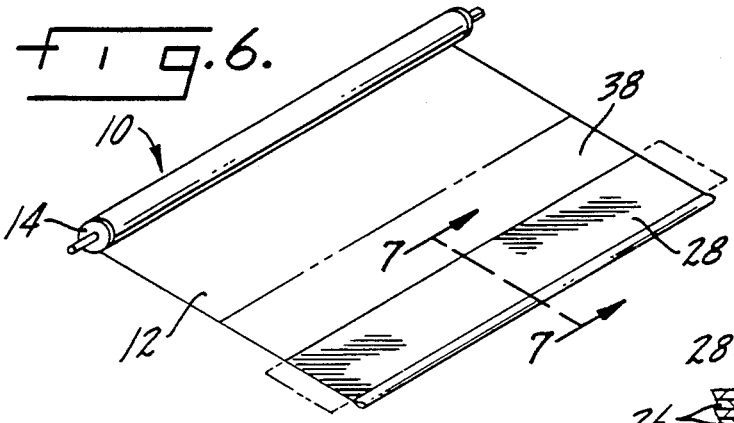
FIG. 6 is a perspective view of a window shade decorated in accordance with the present invention.
Figure 7:
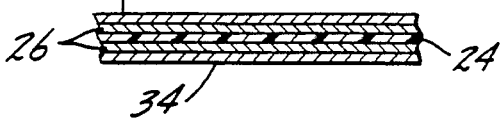
FIG. 7 is a sectional view taken along line 7—7 of FIG. 6.

FIG. 6 shows the mounting strip 24, with the decoration 28 applied to the lower portion 34 of the shade material 12. Depending upon the size of the decoration 28, trimming of excess length may be necessary. If a decoration 28 which is longer than the width of the mounting strip 24 is desired, an additional or second mounting strip 38 can be cut and placed adjacent to the first mounting strip 24 in parallel abutting relationship. Similarly, if a wide shade is to be decorated, longitudinal sections of mounting strips can be abutted end to end to cover the full width of a wide shade. Care should be taken to tightly abut the adjacent sections of mounting strips to prevent stress and strain in the decorative material. The mounting strip 24 shown in the figures is about 6 inches wide and 36 inches long. It is expected that such a mounting strip would fulfill a large number of decorative objectives without creating large amounts of wasted mounting strip material.

The mounting strip 24, which is a polyester material, has a preferred thickness of about 0.007 inches. Polyester of this thickness has been chosen so that the mounting strip 24 will have sufficient rigidity to make handling and placement as easy and convenient as possible without making the mounting strip too floppy. The thickness has also been chosen to make the mounting strip easy to cut with a household scissors, where the user has ordinary hand strength. The mounting strip 24, therefore, combines numerous features including engineering properties of low coefficient of thermal expansion, resistance to sunlight, adhesive characteristics, as well as practical aspects of handiness and cutability.

It is recommended that the following procedure be used in decorating a window shade in accordance with the invention. First, the shade should be partially unrolled and placed on a flat surface, as in FIG. 1. The directions for use 40, appearing on the cover 20, should be read carefully. A piece of decorative material 28 should then be cut to approximately the desired size. The cover 20 should be removed from one side of the mounting strip 24. The material 28 should then be placed onto the mounting strip, as in FIG. 4. Care should be taken to properly align the material, since removal once contact is made would be difficult. Any uncovered portions 25 of the mounting strip 24 should be trimmed, as shown in FIG. 5, with a scissors or blade, with care being taken not to cut the decorative material 28.

Before removing the second cover 22, a light line 16, as shown in FIG. 1, can be drawn on the shade with a pencil to facilitate alignment. Then, the cover 22 should be removed, and the mounting strip placed o the lower portion 34 of the shade. Any excess mounting strip (with decorative material attached) should be trimmed from the end (or ends, if symmetry is required).

In the foregoing example, it was assumed that the widths of the shade and decorative material were both smaller than the length of the original mounting strip. If multiple pieces of mounting strip are required to accommodate a large section of decorative material or a large shade, abutting pieces may be required. If abutting pieces are required, the abutments should be as tight as possible so as to prevent stress and strain in the decorative material.

While a specific embodiment of the invention has been shown and described, it will be apparent to those skilled in the art that numerous alternatives, modifications, and variations of the embodiment shown can be made without departing from the spirit and scope of the appended claims.

I claim:

1. A combination of window shade components which are able to be assembled into an operable window shade assembly comprising:

a roller, means for supporting said roller with respect to a window, a flexible sheet carried by said roller, means for attaching said sheet to said roller, a piece of decorative material, and means for vertically supporting said piece of decorative material and attaching said piece of decorative material to at least a portion of said sheet, said means for supporting and attaching said decorative material comprising a semi-rigid generally flat strip having adhesive on both sides thereof and a removable cover on both sides thereof.

2. A combination of window shade components in accordance with claim 1 wherein:

said strip is made of a polyester material.

3. A combination of window shade components in accordance with claim 1 wherein:

said strip is cuttable by hand using a scissors.

4. A combination of window shade components in accordance with claim 2 wherein:

said strip is about 0.007 inches thick.

5. A combination of window shade components in accordance with claim 1 wherein:

printed step-by-step instructions for installing said decorative material onto said flexible sheet are included with said components.

6. A combination of window shade components in accordance with claim 5 wherein:

said step-by-step instructions are printed on a portion of said removable cover.

7. A combination of window shade components which are able to be assembled into an operable window shade assembly comprising:

a roller, means for supporting said roller with respect to a window, a flexible sheet carried by said roller, means for attaching said sheet to said roller, a piece of decorative material, and means for vertically supporting said piece of decorative material and attaching said piece of decorative material to at least a portion of said sheet, said means for attaching said decorative material comprises a generally thin flat adhesive strip having rigidity sufficient to prevent it from rolling around said roller, whereby delamination of said decorative material and said strip, from one another and from said flexible sheet, is prevented.

8. A combination of window shade components in accordance with claim 7 wherein said strip has a width substantially less than the length of said shade.

9. A combination of window shade components in accordance with claim 1 wherein:

said adhesive is acrylic and is characterized in that its adhesion increases with time.

* * * * *